US009347172B2

(12) United States Patent
Sielmann et al.

(10) Patent No.: US 9,347,172 B2
(45) Date of Patent: May 24, 2016

(54) METHOD OF FOLDING ITEMS OF LAUNDRY

(71) Applicant: Herbert Kannegiesser GmbH, Vlotho (DE)

(72) Inventors: Jorg Sielmann, Bielefeld (DE); Christian Herzberg, Bad Salzuflen (DE); Alexander Serikow, Bunde (DE); Lars Herzog, Bielefeld (DE); Rene Pleitner, Bielefeld (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 14/496,035

(22) Filed: Sep. 25, 2014

(65) Prior Publication Data

US 2015/0094195 A1 Apr. 2, 2015

(30) Foreign Application Priority Data

Sep. 27, 2013 (DE) ..... 10 2013 016 075
Dec. 12, 2013 (DE) ..... 10 2013 020 912

(51) Int. Cl.
*D06F 89/00* (2006.01)
*B65B 63/04* (2006.01)
*B65B 59/02* (2006.01)

(52) U.S. Cl.
CPC ..... *D06F 89/00* (2013.01); *B65B 59/02* (2013.01); *B65B 63/04* (2013.01)

(58) Field of Classification Search
CPC ..... D06F 89/00; D06F 89/005; B65B 63/045; B65B 63/00; B65B 63/04; B65B 61/00; B65B 59/00; B65B 59/05; B31B 1/26; B31B 1/36
See application file for complete search history.

(56) References Cited

U.S. PATENT DOCUMENTS 2,345,411 A * 3/1944 Moeller ..... B26D 9/00 101/248
3,260,518 A * 7/1966 Kamberg ..... D06F 89/00 493/19

(Continued)

FOREIGN PATENT DOCUMENTS

DE 2228284 A1 2/1974
DE 3419146 A1 1/1985

(Continued)

OTHER PUBLICATIONS

Deutsches Patent—Und Markenamt (German Patent and Trdemark Office), Recherchebericht (patent search on related application), Jan. 13, 2014.

(Continued)

*Primary Examiner* — Ismael Izaguirre
(74) *Attorney, Agent, or Firm* — Laurence P. Colton; Smith Tempel Blaha LLC

(57) ABSTRACT

In apparatuses for automatically folding items of laundry, items of laundry of different lengths usually are folded in an irregular sequence, resulting in idling and/or delays in particular in the longitudinal-folding station (13). The invention provides for determining the length of each item of laundry (10) upstream of the longitudinal-folding station (13) and for accelerating short items of laundry as they are transported through the longitudinal-folding station (13), whereas larger items of laundry are slowed down in the longitudinal-folding station (13). Following completion of the longitudinal-folding operation, the respectively folded item of laundry is located at the end of the longitudinal-folding station (13) and, immediately following completion of the longitudinal folding, is transported away out of the longitudinal-folding station (13). This avoids unnecessary idling times, and for relatively long items of laundry to be folded longitudinally during continuous, relatively slow onward transportation through the longitudinal-folding station (13).

12 Claims, 6 Drawing Sheets

(56) References Cited

U.S. PATENT DOCUMENTS

| | | | | | |
|---|---|---|---|---|---|
| 4,093,205 | A | * | 6/1978 | Kober | B65H 45/04 493/425 |
| 4,269,402 | A | * | 5/1981 | Fischer | B41F 13/58 101/227 |
| 4,969,862 | A | * | 11/1990 | Ehlscheid | B31D 1/04 493/357 |
| 5,556,360 | A | | 9/1996 | Kober | |

FOREIGN PATENT DOCUMENTS

| | | | |
|---|---|---|---|
| DE | 10241448 | A1 | 3/2004 |
| DE | 102006021901 | A1 | 11/2007 |
| EP | 0881320 | A1 | 12/1998 |
| EP | 2369051 | A1 | 9/2011 |
| EP | 2392727 | A1 | 12/2011 |

OTHER PUBLICATIONS

European Patent Office, Europaischer Teilrecherchenbericht (European Search on related application), Jan. 29, 2015.

European Patent Office, Europaischer Recherchenbericht (search in a related application), Jun. 24, 2015.

* cited by examiner

METHOD OF FOLDING ITEMS OF LAUNDRY

STATEMENT OF RELATED APPLICATIONS

This patent application claims foreign priority on German Patent Application No. DE 10 2013 016 075.8 having a filing date of 27 Sep. 2013 and German Patent Application No. 10 2013 020 912.9 having a filing date of 12 Dec. 2013.

BACKGROUND OF THE INVENTION

1. Technical Field

The invention relates to a method of folding items of laundry. The invention further relates to a method of mechanically folding items of laundry and/or stacking items of laundry, wherein the items of laundry are transported through at least one longitudinal-folding station, the items of laundry are folded longitudinally at least once in the longitudinal-folding station and preferably the folded items of laundry are stacked at a plurality of stacking locations. The invention additionally relates to a method of folding items of laundry, wherein the items of laundry are transported through a longitudinal-folding station having at least one folding template and, in the longitudinal-folding station, the items of laundry are folded over on the at least one folding template by way of blowing air.

2. Prior Art

The operation of folding items of laundry automatically takes place in folding machines having at least one longitudinal-folding station. The items of laundry are conveyed individually through the longitudinal-folding station and folded longitudinally in the process. During the longitudinal-folding operation, the items of laundry are provided with at least one folding line running in the longitudinal direction of the longitudinal-folding station.

It is usually the case that items of laundry of different sizes are folded one after the other. All the items of laundry—regardless of size—are thereby transported through the longitudinal-folding station at the same speed. This means that it is only possible for relatively small items of laundry, but not larger items of laundry, to be folded during uninterrupted onward transportation through the longitudinal-folding station. As a result, the onward transportation of larger items of laundry through the longitudinal-folding station is interrupted for longitudinal-folding purposes. This results in the cycle time being extended.

It is also known for the items of laundry to be folded by way of blowing air with the aid of folding templates of the longitudinal-folding station. The blowing air acts on the items of laundry which are to be folded until it can be assumed with a degree of certainty that items of laundry of any size, but also of any width and any desired materials, have been definitively folded. As a result, the blowing-time duration is adapted to items of laundry of maximum length. In the case of shorter items of laundry, the blowing duration is unnecessarily long. This may result in definitively folded items of laundry still having blowing air acting on them as they are transported away, and some folding may become undone again as a result. Moreover, an unnecessary long blowing duration results in an increased consumption of compressed air and in an unnecessary amount of noise being caused by compressed air exiting from compressed-air nozzles.

BRIEF SUMMARY OF THE INVENTION

It is an object of the invention to provide a method of automatically folding items of laundry which has an enhanced folding performance and/or a shortened blowing time.

A method for achieving this object is a method of mechanically folding items of laundry and/or stacking items of laundry, wherein the items of laundry are transported through at least one longitudinal-folding station, the items of laundry are folded longitudinally at least once in the longitudinal-folding station and preferably the folded items of laundry are stacked at a plurality of stacking locations, characterized in that the items of laundry are transported through the longitudinal-folding station at a transporting speed adapted to their size, wherein the transporting speed is adjusted such that relatively small items of laundry are transported through the longitudinal-folding station more quickly than larger items of laundry. In the case of this method, provision is made for the items of laundry to be transported through the longitudinal-folding station at a transporting speed adapted at least to their size, in particular length. Length of the items of laundry means that direction of extent of the same which runs in the direction in which the items of laundry are transported through the longitudinal-folding station. In the case of this method according to the invention, less time is lost, in comparison with the conventional method, when small and large items of laundry are to be folded randomly, that is to say in a mixed-together state.

The speed at which the items of laundry are transported through the longitudinal-folding station is preferably adjusted such that the longitudinal-folding operation has been completed when the leading transverse edge of the respective item of laundry is located in the region of an outlet end of the longitudinal-folding station, that is to say is located at the outlet end or just upstream thereof. This means that items of laundry of any type and size, to be precise large items of laundry and small items of laundry, are transported as quickly as possible through the longitudinal-folding station, wherein the speed is selected such that the duration over which the items of laundry are transported through the longitudinal-folding station is sufficient for each item of laundry to be folded longitudinally in full at least once. Accordingly, relatively large items of laundry are transported through the longitudinal-folding station more slowly than smaller items of laundry.

Adapting the speed at which the items of laundry are transported through the longitudinal-folding station, on the one hand, avoids interruption in the onward transportation of relatively large items of laundry through the longitudinal-folding station and, on the other hand, means that, with smaller items of laundry being transported more quickly through the longitudinal-folding station, it is also the case that small items of laundry have at least more or less reached the outlet end of the longitudinal-folding station once the longitudinal-folding operation has taken place. It is only when very large items of laundry of a length corresponding approximately to the length of the longitudinal-folding station have to be folded that it is also necessary to provide a brief interruption in the onward transportation of the item of laundry in order for the latter to be folded in the longitudinal-folding station.

Provision is preferably made for the speed at which short or small items of laundry are transported through the longitudinal-folding station to be selected to be greater than for longer or larger items of laundry and/or for short or small items of laundry to be accelerated in the longitudinal-folding station and for larger, in particular longer, items of laundry to be slowed down. This provides for individual adaptation of the speed at which the items of laundry are transported through the longitudinal-folding station. It is also possible here for relatively large items of laundry—provided they are not items of laundry which take up the entire length of the longitudinal-folding station—to be folded without any interruption in their onward transportation and for smaller items of laundry to be transported through the longitudinal-folding station at a greater transporting speed, and therefore the operation of folding items of laundry of different sizes takes place over at least most of the length of the longitudinal-folding station. This eliminates standstill periods in the longitudinal-folding station and periods for transporting the already definitively folded small item of laundry to the outlet end of the longitudinal-folding station.

A preferred configuration of the method provides for the speed at which the items of laundry are transported through the longitudinal-folding station to be adapted individually and preferably continuously at least to the length of the item of laundry which is to be folded in each case and to be adjusted accordingly. The speed at which the items of laundry are transported in the longitudinal-folding station is preferably adapted individually to the amount of time required for the longitudinal-folding operation, which is smaller for relatively short items of laundry than it is for longer items of laundry. This adaptation takes place such that, during the amount of time required for the longitudinal-folding operation, the item of laundry has been transported throughout the entire longitudinal-folding station, and therefore, at the completion of each longitudinal-folding operation or of all the longitudinal-folding operations of the respective item of laundry, the leading (front) transverse edge of the same, to be precise both of large items of laundry and of small items of laundry, is located at the outlet end, or in the vicinity of the outlet end, of the longitudinal-folding station. As a result of this method, all the items of laundry, irrespective of their size or length, pass through the longitudinal-folding station in an extremely short amount of time and the at least one longitudinal-folding operation is completed in full in the process.

According to an advantageous development of the method, provision is made for the speed at which the items of laundry are supplied to the longitudinal-folding station to be adapted to the speed at which the items of laundry are transported through the longitudinal-folding station. This ensures that, in the case of small items of laundry, which are transported quickly through the longitudinal-folding station, next-following items of laundry are supplied to the longitudinal-folding station at the smallest possible distance apart from the preceding item of laundry. Conversely, in the case of large items of laundry, which are transported slowly through the longitudinal-folding station, the operation of feeding following items of laundry to the longitudinal-folding station is slowed down, in order that the situation where successive items of laundry run over one another or overlap in the longitudinal-folding station does not arise.

Provision is preferably made for the speed at which the items of laundry are supplied to the longitudinal-folding station to be adjusted such that the items of laundry run into the longitudinal-folding station closely one after the other and/or the next item of laundry is transported into the longitudinal-folding station as soon as the longitudinal-folding operation of the preceding item of laundry has been completed. This reduces idling times of the longitudinal-folding station to a minimum.

A particularly advantageous configuration of the method provides for the sizes of the items of laundry, that is to say the dimensions of the items of laundry in the transporting direction through the longitudinal-folding station, to be determined in good time before the beginning of the longitudinal-folding operation or of the first longitudinal-folding operation. The length of the respective item of laundry, to be precise preferably of the item of laundry which is the next to be folded, is preferably determined upstream of the longitudinal-folding station and/or during transportation to the longitudinal-folding station. Determination of length can take place by means of at least one sensor. This may be, for example, such a sensor as determines the duration between the front transverse edge of a respective item of laundry running past the sensor and the rear transverse edge thereof running past the same. As the transporting speed of the item of laundry is known, this means that the length of the item of laundry can be calculated. It is also conceivable, however, to use a displacement sensor by means of which the length of the item of laundry transported past it is sensed in a contactless manner or in contact with the item of laundry.

Another advantageous configuration of the method provides for the folded items of laundry to be transported from the final folding station to different stacking locations downstream of the final folding station at different supply speeds. Since the stacking locations, which are arranged one beside the other or one behind the other, necessarily have to be at different distances from the final folding station, the different supply speeds mean that the folded items of laundry require approximately the same amount of time to reach the stacking stations at different distances from the final folding station. In particular when the items of laundry are transported through the longitudinal-folding station at a transporting speed adapted to their size, and therefore the longitudinal-folding duration is approximately the same for each item of laundry, it can thus be ensured that it is also the case that the operation of stacking the items of laundry takes place in approximately the same amount of time and there is therefore no need to wait until items of laundry which are to be stacked at remote stacking locations have reached said remote stacking locations.

As an alternative, it is conceivable for relatively small items of laundry, which are transported at a relatively great transporting speed through the longitudinal-folding station, to be stacked at stacking locations which are remote from the final folding station, whereas longer items of laundry, which require a lower transporting speed through the longitudinal-folding station, are stacked at stacking stations which are closer to the final folding station. This can effect a kind of synchronization between the amounts of time required for folding and the amounts of time required for stacking, preferably in dependence on the dimensions of the respective item of laundry.

A further method for achieving the object mentioned in the introduction, it also being possible for this method to be a preferred development of the method described above, is a method of folding items of laundry, wherein the items of laundry are transported through a longitudinal-folding station having at least one folding template and, in the longitudinal-folding station, the items of laundry are folded over on the at least one folding template by way of blowing air, characterized in that, during the longitudinal-folding operation, an upper region of a folding region or blowing space above the at least one folding template is monitored as to whether there is still at least part of the respectively folded item of laundry located in the upper region of the folding region or blowing space, and the at least one folding operation and/or the supply of blowing air are/is controlled correspondingly. In the case of this method, provision is made, during the longitudinal-folding operation, for an upper region of a folding zone, in particular of a blowing space, located above the folding templates to be monitored as to whether there is still at least part of the item of laundry located in said monitored upper region. It is established here whether the item of laundry, or a part of the same which is to be folded longitudinally in each case, has left the monitored upper region. This is an indication of the termination of the respective longitudinal-folding operation. This method makes it possible to determine the duration of the respective longitudinal-folding operation and, in particular, to establish when the longitudinal-folding operation, which will last for different periods of time depending on the size of the item of laundry, has terminated.

Provision is preferably made for the supply of the blowing air which is necessary for folding purposes to be interrupted or terminated when it has been established that the relevant folding operation of the item of laundry currently located in the longitudinal-folding station, in particular a part of the same, has terminated. Preferably then, at the same time, the supply of blowing air to the following longitudinal-folding operation of the same item of laundry is started or released. It is thus possible for the blowing-air duration to be adapted to the duration of the respective longitudinal-folding operation and to achieve the situation where the blowing air acts on the item of laundry which is to be folded longitudinally only until the respective longitudinal-folding operation has taken place.

In the case of an advantageous development of the method, provision is made for only such an upper region of the folding or blowing zone or of the blowing space as has its lower plane located at a distance, preferably at a parallel distance, above the folding templates to be monitored. This distance is selected, in particular, such that said upper region is located above a main-extent surface area of the item of laundry which is located in the longitudinal-folding station in each case. On the one hand, the main-extent surface area of the item of laundry is that surface area which runs through the highest point of the as yet non-folded item of laundry located in the longitudinal-folding station. This is based on the finding that the non-folded item of laundry is located in a somewhat undulating state, rather than completely smoothly, in the longitudinal-folding station, and therefore the main-extent surface area is that surface area which does not go beyond the item of laundry located, possibly in a puckered state, in the longitudinal-folding station. On the other hand, the main-extent surface area is that surface area which is located closely above the highest point of the longitudinally folded item of laundry. Monitoring just the upper region of the folding zone or of the blowing space above the folding templates, said upper region being located above the main-extent surface areas, means that monitoring is provided for specifically that region through which, during the longitudinal-folding operation, at least part of the item of laundry which is to be folded longitudinally in each case is moved as it is folded over by the blowing air. Once the preferably outer parts of the item of laundry have been folded over in a longitudinally directed manner one after the other around the folding templates by the blowing air, the respectively longitudinally folded part, following each longitudinal-folding operation, leaves the upper region of the folding or blowing zone again, which is detected by the monitoring and thus indicates the end of the respective folding operation. This reliably provides the correct point in time for terminating the supply of blowing air, and the supply of blowing air for the longitudinal-folding operation which has taken place is terminated specifically.

According to an advantageous configuration of the method, at least one line through the lower plane of the upper region of the folding zone or of the blowing space is monitored. This can be done by way of at least one light barrier or the like extending preferably transversely, but possibly also longitudinally, via the longitudinal-folding station. It is also conceivable, however, for the lower plane of the upper region of the folding zone to be monitored by a plurality of parallel longitudinally and/or transversely running light barriers or the like which are located in said plane, and follow one after the other in particular along the longitudinal extent of the longitudinal-folding station. It is also conceivable for image-forming means to monitor the entire upper region of the blowing space or of the folding zone three-dimensionally for the presence of part of an item of laundry in said region. The linear, two-dimensional or three-dimensional options outlined for monitoring the upper region or the lower plane of the upper region can reliably determine whether there is still part of an item of laundry located in the upper region above the blowing or folding zone. In particular, it is thus possible to determine the point in time, corresponding to the end of the respective folding operation, at which the final point of the item of laundry which is to be folded longitudinally in each case has left the monitored upper region of the blowing or folding zone.

BRIEF DESCRIPTION OF THE DRAWINGS

Preferred exemplary embodiments of the invention will be explained in more detail hereinbelow with reference to the drawing, in which.

DETAILED DESCRIPTION OF PREFERRED EMBODIMENTS

Figure 1:
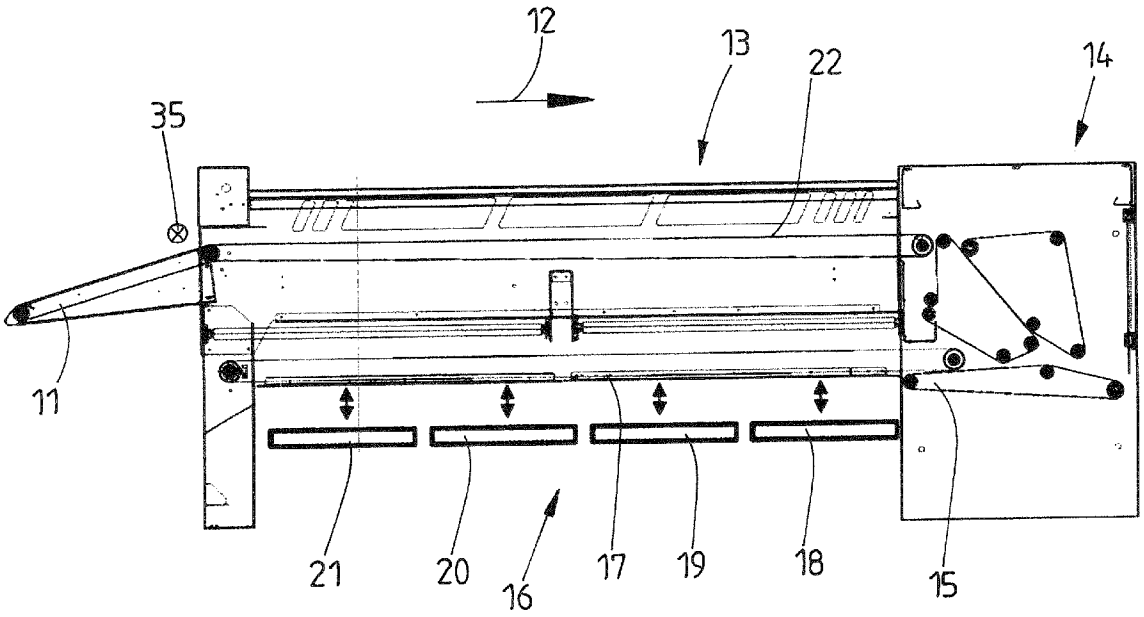
FIG. 1 shows a schematic view of an apparatus for folding and stacking items of laundry.

The apparatus shown in FIG. 1 serves for automatically folding items of laundry 10 and for simultaneously stacking folded items of laundry 10. The items of laundry 10 may be of any desired type, preferably so-called flat textile products such as sheets, blankets, pillowcases, tablecloths, napkins or the like, but also towels, including those made of terry cloth. The invention also relates to apparatuses which serve for folding and/or stacking other items of laundry, for example items of clothing, so-called shaped items. The invention further relates to apparatuses which serve only for folding items of laundry 10.

The apparatus has, on the left-hand side in FIG. 1, an infeed table 11 with at least one circulating infeed conveying belt. A spread-out item of laundry 10 which is to be folded in each case is transported in the transporting direction 12 from the infeed table 11 to a longitudinal-folding station 13. In the longitudinal-folding station 13, the respective item of laundry 10 is folded longitudinally at least once. In the case of the exemplary embodiment shown, two longitudinal-folding operations take place one after the other from opposite longitudinal sides of the item of laundry 10. This gives the item of laundry 10 two parallel folding lines running in the transporting direction 12, that is to say longitudinally in relation to the longitudinal-folding station 13, on opposite sides of the centre of the item of laundry, as seen in the transporting direction 12.

The respective item of laundry 10 is transported from the longitudinal-folding station 13 into a cross-folding station 14 of the apparatus shown here. In the cross-folding station 14, the respective item of laundry 10 is folded transversely at least once. The folded item of laundry 10 is transported by a lower delivery conveyor 15, counter to the transporting direction 12 of the longitudinal-folding station 13, to a stacking device 16, which is located beneath and/or alongside the longitudinal-folding station 13.

The stacking device 16 has a conveyor 17 which runs parallel to the longitudinal-folding station 13 and, in the exemplary embodiment shown, is assigned four stackers following one after the other in the transporting direction 12, for example lifting trucks 18, 19, 20 and 21, which are shown in FIG. 1. The lifting trucks 18 to 21 are at different distances from the delivery conveyor 15 of the cross-folding station 14, and therefore the conveying routes to the individual lifting trucks 18 to 21 are of different lengths. The shortest conveying route leads to the lifting truck 18 and the longest conveying route leads to the furthest-away lifting truck 21. The conveyor 17 is assigned, on each lifting truck 18 to 21, stacking plates, which each deposit a folded item of laundry 10 on the relevant lifting truck 18, 19, 20 and 21 or on the stack of folded items of laundry 10 already formed thereon.

In the case of the apparatus shown here, a length-measuring device 35 is provided upstream of the longitudinal-folding station 13. The length-measuring device 22 may also be provided at the end of the infeed table 11 or at the start of the longitudinal-folding station 13. The length-measuring device 35 may be a sensor which determines the length of the item of laundry 10 in the transporting direction 12, that is to say in the longitudinal direction of the longitudinal-folding station 13, in a contactless manner. The contactlessly operating sensor determines the amount of time which the respective item of laundry 10 requires in order to be transported past it. The length of the item of laundry 10, (as seen in the transporting direction 12) can be calculated from this amount of time in conjunction with the known constant speed at which the item of laundry 10 is transported along the sensor. It is also conceivable, however, to have a displacement sensor rolling on the item of laundry 10 and, in the process, determining the distance between the front transverse edge and the rear transverse edge of the item of laundry 10 as it butts against the item of laundry 10, this distance being a direct indication of the length of the item of laundry 10.

Figure 4:
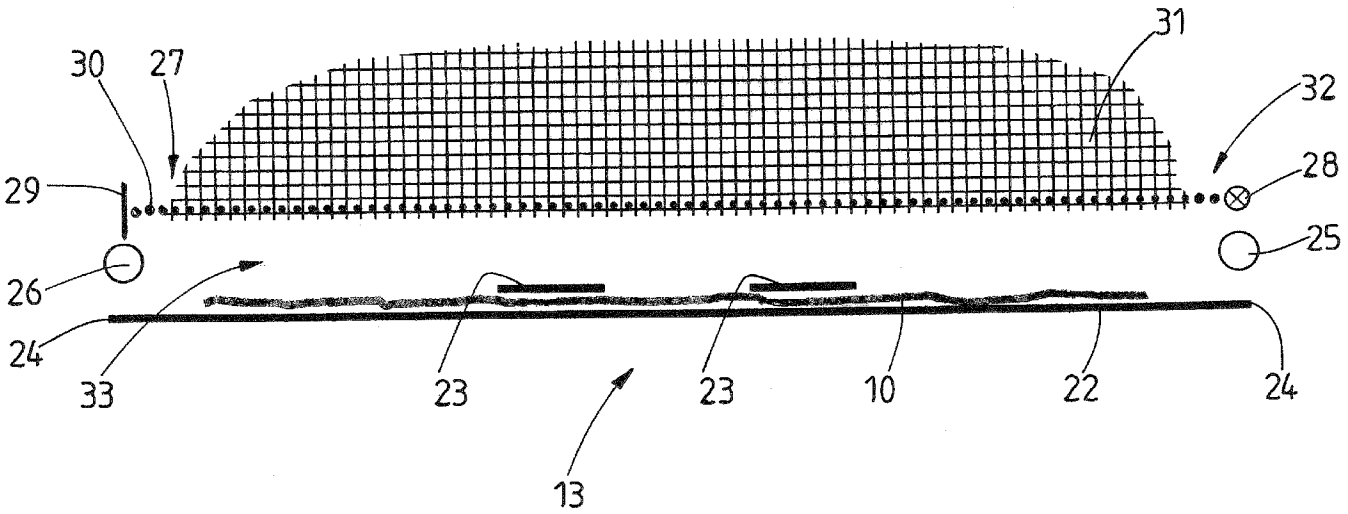
FIG. 4 shows a schematic cross section through the longitudinal-folding station of the apparatus from FIGS. 1 to 3, with an as yet non-folded item of laundry.

The longitudinal-folding station 13 has a longitudinal conveyor 22, which is continuous over the entire width and length of the longitudinal-folding station. The longitudinal conveyor 22 transports the item of laundry 10 through the longitudinal-folding station 13 in the transporting direction 12. The longitudinal conveyor 22 has a circulating conveying belt which is continuous over the entire width of the longitudinal-folding station 13 or has a plurality of narrow conveying belts located one beside the other. The item of laundry 10 is spread out in the as yet non-folded state on the at least one conveying belt of the longitudinal conveyor 22 (FIG. 4).

In the exemplary embodiment shown, two elongate folding templates 23 are provided at a small distance above the upper strand of the at least one circulating belt of the longitudinal conveyor 22. The elongate, strip-like folding templates 23 extend parallel to one another in the longitudinal direction of the longitudinal-folding station 13. In the exemplary embodiment shown, the folding templates 23, spaced apart parallel to one another, are assigned to different halves of the longitudinal conveyor 22. The folding templates 23 can be spaced apart differently from one another for adaptation to items of laundry 10 of different sizes, in particular of different widths. Apart from this, the folding templates 23 are arranged in a fixed position at a small distance above the longitudinal conveyor 22. Outer sub-regions of the item of laundry 10 are folded over one after the other first of all around the one folding template 23 and then around the other folding template 23 and, as a result, two longitudinal-folding operations are carried out one after the other in order to fold the item of laundry 10 in thirds in relation to the width of the same.

Figure 5:
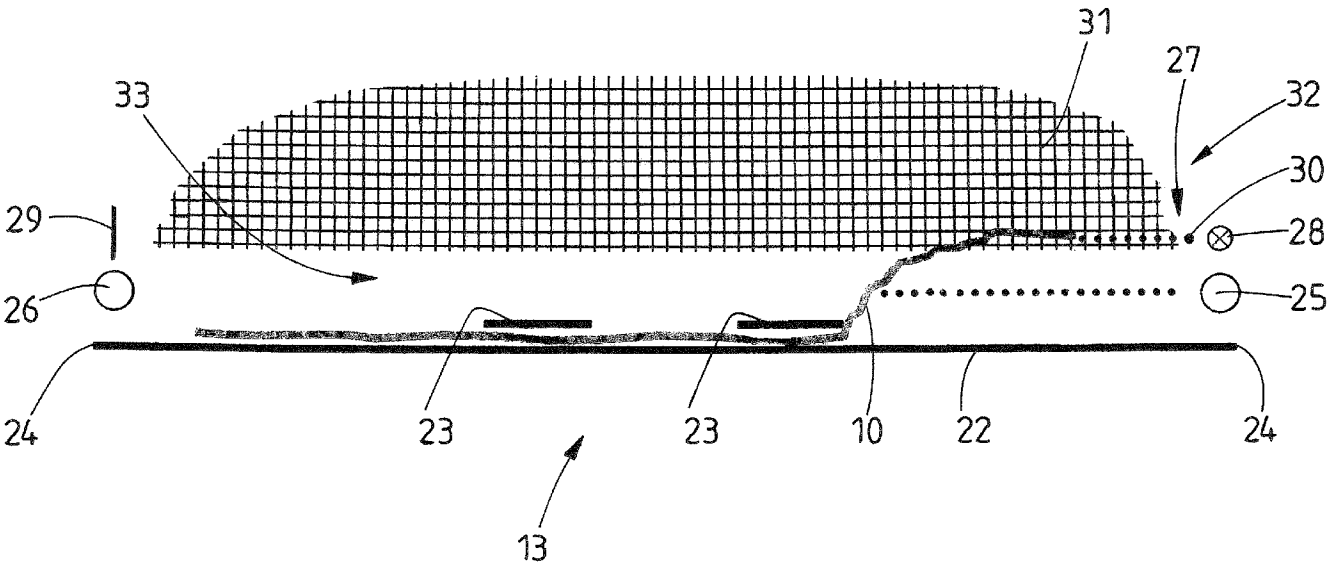
FIG. 5 shows a view analogous to FIG. 4 during the longitudinal-folding operation of a right-hand part of the item of laundry.

The longitudinal-folding operation of the item of laundry 10 takes place pneumatically by way of compressed air in the longitudinal-folding station 13 shown here. For this purpose, blowing tubes 25, 26 are arranged along each of the opposite, parallel longitudinal peripheries 24 of the longitudinal-folding station 13. In the exemplary embodiment shown, the elongate, blowing tubes 25, 26 running parallel to one another are arranged in a plane which is located some way above the folding templates 23 (FIG. 5). Each blowing tube 25, 26 serves for carrying out a longitudinal-folding operation of the item of laundry 10. It is preferably the case that the identically designed blowing tubes 25, 26 are provided, on their side which is oriented towards the center of the longitudinal-folding station 13, with in each case at least one row of blowing nozzles, from which compressed-air jets exit. It is possible for the blowing nozzles to generate a cylindrical compressed-air jet, but also a slightly conical one. It is also conceivable for the blowing tubes 25, 26 to be rotatable to some extent, for example to be rotatable back and forth in opposite directions, about their longitudinal axes in order to fold the item of laundry 10.

At least one light barrier 27 is provided above the blowing tubes 25, 26. A light barrier 27 which runs horizontally transversely to the transporting direction 12 is illustrated symbolically in FIGS. 4 to 6. The light barrier 27 has at least one light source 28 (on the right in FIGS. 4 to 6) and a reflector 29 (arranged above the left-hand blowing tube 26 in FIGS. 4 to 6) located opposite. The light barrier 27—when interrupted—generates a horizontal sensor line 30, which is symbolized by a row of spots of light in FIGS. 4 to 6. The light source 28 and the reflector 29 are arranged at a small distance above the blowing tubes 25, 26, and therefore the sensor line 30 of the light barrier 27 is located at a parallel distance above a horizontal line/plane of connection between the blowing tubes 25, 26. This sensor line 30 constitutes a lower boundary of an upper region 31 which is symbolized by a grid of lines in FIGS. 4 to 6 and forms part of a folding space, namely a blowing space 32, of the longitudinal-folding station 13, said space being located above the folding templates 23. The sensor line 30 thus subdivides the blowing space 32 into the upper region 31 and a lower region 33, which is located between the sensor line 30 and the folding templates 23. The height of the lower region 33 is selected such that a main-extent surface area of the folded and also non-folded or merely partially folded item of laundry 10 is located in it, that is to say each definitively folded item of laundry 10, once the right-hand and left-hand peripheral regions have been folded over around the folding templates 23, occupies only the lower region 33, but not the upper region 31, and therefore each definitively folded item of laundry 10 is located beneath the sensor line 30.

Since the elongate blowing tubes 25, 26 give rise to each side part of an item of laundry 10 being folded over uniformly around the respective folding template 23, as seen in the longitudinal direction of the longitudinal-folding station 13, it is sufficient for a single light barrier 27 with a sensor line 30 running transversely to the transporting direction 12 to be provided above the plane of the blowing tubes 25, 26. It is also conceivable, however, for a plurality of light barriers 27, distributed at more or less large intervals over the length of the longitudinal-folding station 13, with parallel, horizontal sensor lines 30 to be provided. It is then possible for the lower plane of the upper region 31 of the blowing space 32 to be sensed in a contactless manner over the surface area.

It is also conceivable for image-forming means, for example cameras, to monitor the entire upper region 31 of the blowing space 32 three-dimensionally.

The apparatus has a control means and/or circuit (not shown), to which the measured length of the item of laundry 10 supplied to the longitudinal-folding station 13 in each case is made available. The speed of the longitudinal conveyor 22 of the longitudinal-folding station 13 is then altered, in particular adapted, with reference to the length of the respective item of laundry 10, to be precise such that a front transverse edge 36 of the respective item of laundry 10, following completion of the longitudinal-folding operation, has been transported as closely as possible up to an outlet end 34 at the front transverse edge of the longitudinal-folding station 13.

The same control means or circuit, or a separate control means or circuit, receives a signal from the light barrier 27 when a peripheral region of the item of laundry 10 which is to be folded over around the folding templates 23 by the air jets of the blowing tubes 25, 26 is no longer located in the upper region 31 of the blowing space 32.

The circuit or control means for adapting the transporting speed of the longitudinal conveyor 22 of the longitudinal-folding station 13 to the length of the item of laundry 10 can also be used to determine on which of the lifting trucks 18 to 21 located at different distances from the delivery conveyor 15 the respectively folded item of laundry 10 is deposited. The control means registers the size of the respective item of laundry 10 and the speed at which it has been transported through the longitudinal-folding station 13 and, accordingly, deposits an item of laundry 10 which has been transported relatively quickly through the longitudinal-folding station 13 onto the rearmost lifting truck 21. Relatively large items of laundry 10 are deposited on the front lifting truck or trucks 18 or 19.

Figure 6:
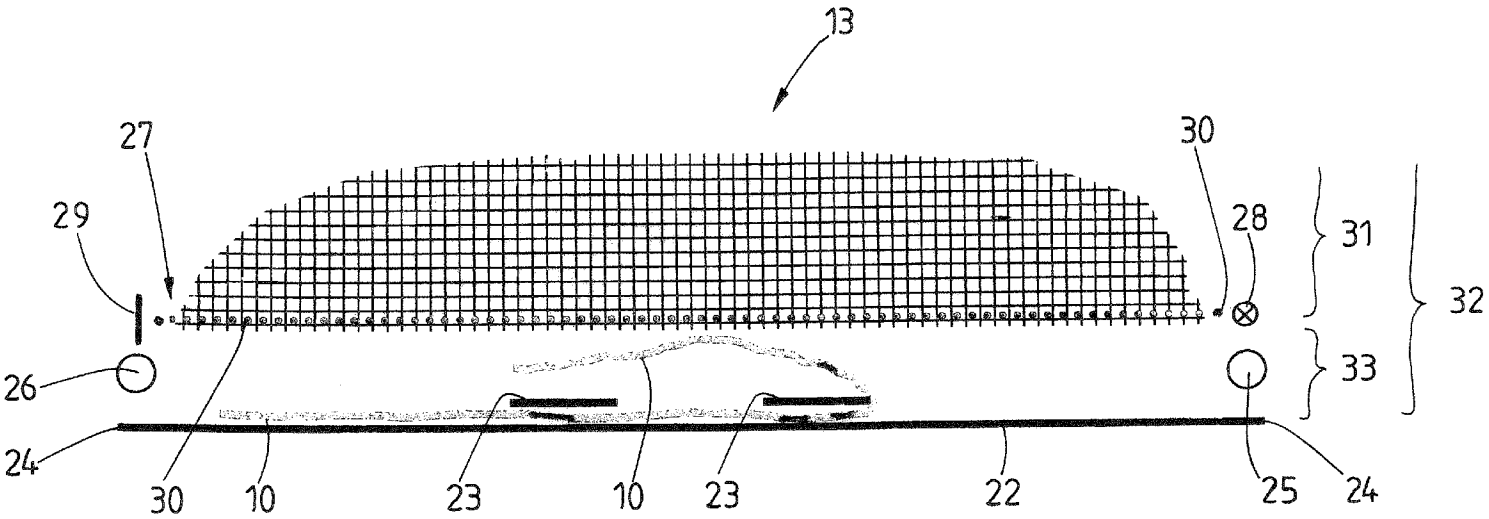
FIG. 6 shows a view analogous to FIGS. 4 and 5 following the longitudinal-folding operation of the right-hand part of the item of laundry.
Figure 7:
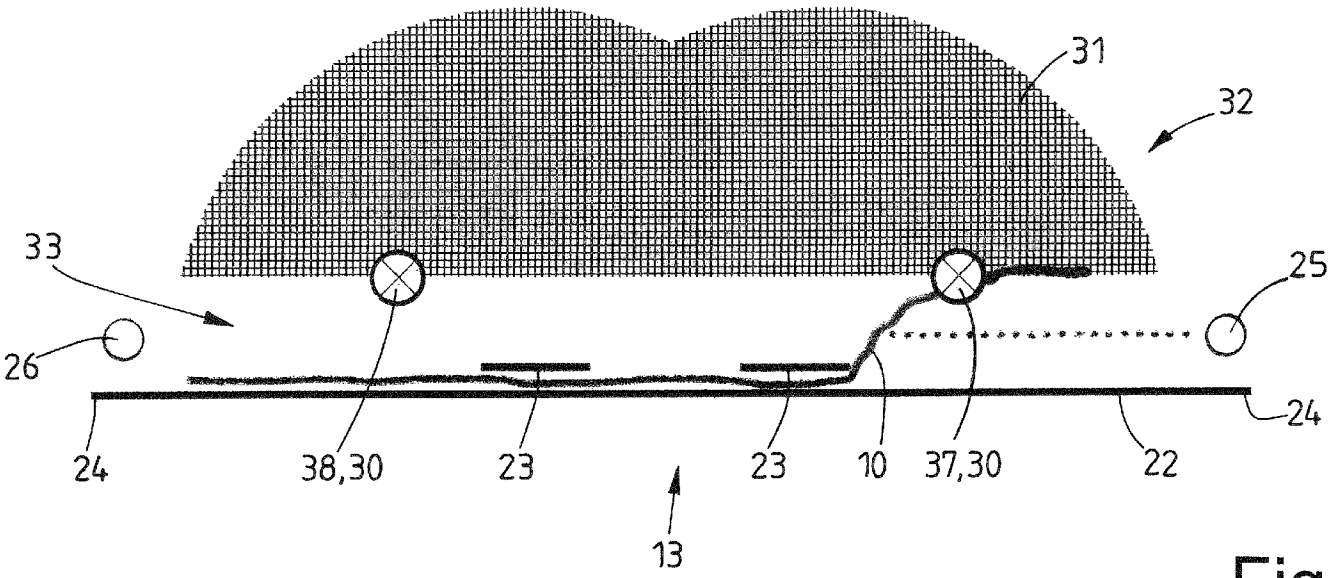
FIG. 7 shows a schematic cross section (analogous to FIG. 5) through the longitudinal-folding station of an apparatus according to another exemplary embodiment of the invention, during the longitudinal-folding operation of a right-hand part of the item of laundry.

The exemplary embodiment of FIG. 7 differs from the previously described exemplary embodiment only by the fact of at least one longitudinally running light barrier being provided instead of the light barrier 27 (of the exemplary embodiment of FIGS. 4 to 6) running transversely to the transporting direction 12. The exemplary embodiment of FIG. 7 provides two parallel longitudinally directed light barriers 37, 38, to be precise one light barrier 37, 38, for each half of the longitudinal-folding station 13. The two light barriers 37, 38 are located in a common horizontal plane some way above the horizontal plane of connection between the blowing tubes 25, 26. The horizontal plane in which the light barriers 37, 38 line is located between an upper region 31 and a lower region 33 of the blowing space 32, that is to say still above the plane of the blowing tubes 25, 26 above the folding templates 23. The distance between the two light barriers 37, 38 is larger than the distance between the outer longitudinal edges of the folding templates 23. This means that the longitudinally directed light barriers 37, 38 are located in a region through which it is necessary to move the outer peripheral strips of the respective item of laundry 10, said outer peripheral strips having to be folded over around the folding templates 23 by blowing air. This allows the longitudinally directed light barriers 37 and 38 to determine reliably whether the longitudinal-folding operation of the respective outer peripheral region of the item of laundry 10 has taken place at least predominantly or not at all.

The method used by the abovedescribed apparatus for folding and stacking items of laundry 10 will be described in more detail hereinbelow in conjunction with the exemplary embodiment of FIGS. 1 to 6.

The longitudinal-folding operation of the items of laundry 10 takes place in dependence on at least the size, preferably length and/or width, of the same, with different transporting speeds for each item of laundry 10 through the longitudinal-folding station 13 in the transporting direction 12. The speed of the longitudinal conveyor 22 in the longitudinal-folding station 13 is adapted here to the size, and possibly the material, of the item of laundry 10 which is to be folded in each case. In particular short items of laundry 10, in other words those of which the lengths are comparatively small as seen in the transporting direction 12 or longitudinal direction of the longitudinal-folding station 13, are transported through the longitudinal-folding station 13 more quickly than longer items of laundry 10. In other words, short items of laundry 10 are accelerated by the longitudinal conveyor 22 in the longitudinal-folding station 13 and longer items of laundry 10 are slowed down by virtue of the longitudinal conveyor 22 of the longitudinal-folding station 13 being braked correspondingly.

The length-measuring device 35, which is arranged at the start, or upstream, of the longitudinal-folding station 13, determines whether the item of laundry 10 is small or large, in particular short or long. The length of the item of laundry 10 is thus known before the beginning of the first longitudinal-folding operation of said item of laundry 10 in the longitudinal-folding station 13. With reference to the previously established size or length of the item of laundry 10, the control means of the longitudinal-folding station 13 determines the speed of the longitudinal conveyor 22 and drives the longitudinal conveyor 22 correspondingly. This means that it is possible for large and small items of laundry 10, during continuous onward transportation through the longitudinal-folding station 13, to be folded longitudinally two times one after the other, to be precise, in the exemplary embodiments of FIGS. 2 and 3, in the first instance a right-hand peripheral region is folded around the right-hand folding template 23 and then a left-hand peripheral region is folded around the left-hand folding template 23. It is also possible for the longitudinal-folding operation to be carried out for relatively large or relatively long items of laundry 10 without any interruption in the onward transportation of the item of laundry through the longitudinal-folding station 13. It is only when the item of laundry 10 which is to be folded in the longitudinal-folding station 13 is large enough to take up virtually the entire length of the longitudinal-folding station 13 that the onward transportation of said very long item of laundry 10 through the longitudinal-folding station 13 has to be stopped briefly for longitudinal-folding purposes.

Figure 2:
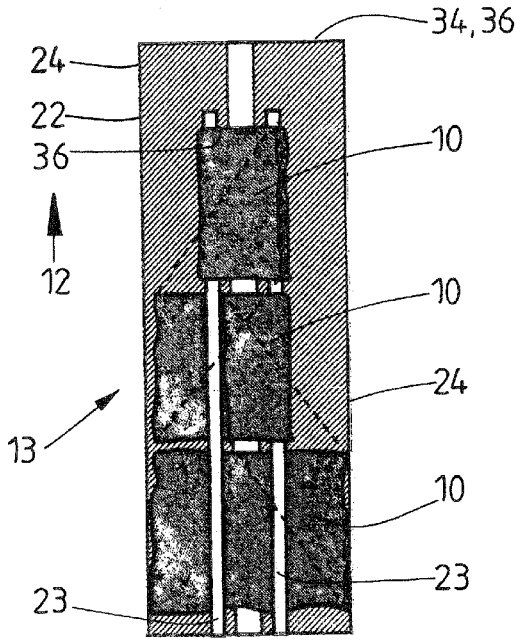
FIG. 2 shows a schematic plan view of a longitudinal-folding station of the apparatus from FIG. 1, with small items of laundry.
Figure 3:
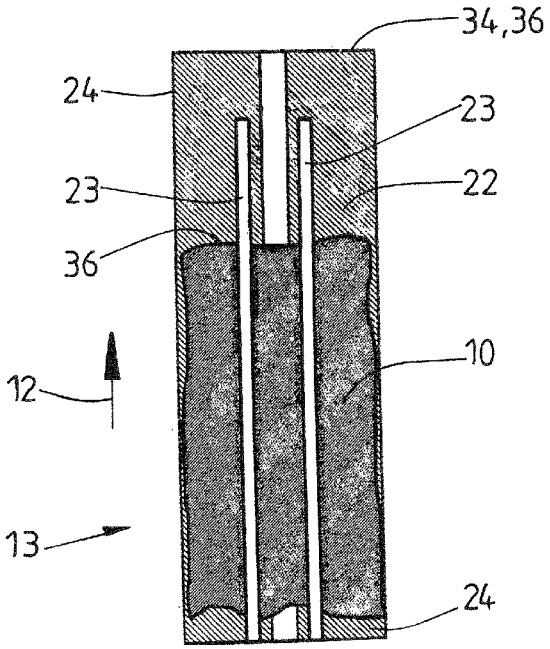
FIG. 3 shows a schematic plan view of the longitudinal-folding station analogous to FIG. 2, with a large item of laundry.

Adaptation of the transporting speed of the longitudinal conveyor 22 of the longitudinal-folding station 13 to the length of the item of laundry 10 which is to be folded longitudinally in each case takes place such that, at the conclusion of the final longitudinal-folding operation in the longitudinal-folding station 13, a front transverse edge 36 of the definitively folded item of laundry 10 is located right at the outlet end 34, that is to say a front transverse edge, of the longitudinal-folding station 13 or right at the front ends of the folding templates 23 (FIG. 2). If at least one short item of laundry 10 (FIG. 2) is followed by a longer item of laundry 10 (FIG. 3), then the speed of the longitudinal conveyor 22 is reduced to the extent where the front transverse edge 36 of the longer item of laundry 10, at the completion of the longitudinal-folding operation in the longitudinal-folding station 13, is located at the front outlet end 34 of said station or in the vicinity of the front outlet end 34 and/or the front ends of the folding templates 23.

As a result of the method described above, items of laundry 10 of different sizes (with the exception of extra-large items of laundry 10 corresponding approximately to the length of the longitudinal-folding station 13) can be folded longitudinally during uninterrupted, continuous onward transportation through the longitudinal-folding station 13. In addition, as a result of the transporting speed of the longitudinal conveyor 22 being adapted in dependence on the length of the items of laundry 10 determined beforehand by the length-measuring device 35, both short and long items of laundry 10, following termination of the longitudinal-folding operation in the longitudinal-folding station 13, have their front transverse edge 36 located at the outlet end 34, or in the vicinity of the outlet end 34, of the longitudinal-folding station 13 and/or at the ends of the folding templates 23.

The method described reduces to a minimum the amount of time required for the items of laundry 10 to pass through the longitudinal-folding station 13 in that, irrespective of their size, in particular length, the items of laundry 10, once folded longitudinally, are located immediately upstream of the outlet end 34 of the longitudinal-folding station 13 and thus, irrespective of their size, all the items of laundry 10, following termination of the final longitudinal-folding operation, can be immediately transported out of the longitudinal-folding station 13 via the outlet end 34.

Provision is preferably also made for the folded items of laundry 10 to be stacked specifically on the lifting trucks 18 to 21. For this purpose, relatively small items of laundry 10, which have been transported through the longitudinal-folding station 13 at a relatively great conveying speed of the longitudinal conveyor 22, and of which the residence time in the longitudinal-folding station 13 is thus shorter than that of larger items of laundry 10, are stacked on lifting trucks 21 or 20, which are respectively furthest away or relatively far away from the delivery conveyor 15 of the cross-folding station 14. In contrast, longer items of laundry 10, which are transported through the longitudinal-folding station 13 more slowly, are deposited on the lifting trucks 18 or 19, which are closer to the delivery conveyor 15. It is therefore the case that relatively long transporting routes taken by folded items of laundry 10 to the rear lifting trucks 20, 21 are combined with relatively short amounts of time required for passage through the longitudinal-folding station 13. In contrast, larger items of laundry 10, which require longer amounts of time for folding in the longitudinal-folding station 13, are deposited on front lifting trucks 18 or 19, which require shorter supply routes. As a result, the amounts of time required for relatively large items of laundry 10 and relatively small items of laundry 10 to pass through the longitudinal-folding station 13 and the stacking device 16 are more or less the same.

As an alternative, it is also conceivable for the conveyor 17, which leads to the lifting trucks 18 to 21, to be driven at such alternating speeds that folded items of laundry 10 are passed to the lifting trucks 18 to 21 within approximately the same amount of time. In this case, the folded items of laundry 10 are transported to the rearmost lifting truck 21 at the greatest transporting speed and to the front lifting truck 18 at the lowest conveying speed. There is no particular need here for the transporting speed of the conveyor 17 to be geared to the size of the folded items of laundry 10; rather, it can be adapted to the conveying route irrespective of the size of the items of laundry 10.

The method also provides for the blowing duration of the blowing tubes 25, 26 to be adapted to the duration of the respective longitudinal-folding operation. This means that the action of the compressed air exiting from the blowing tubes 25 and 26 is terminated as soon as the respective longitudinal-folding operation has been completed. This results in blowing-time regulation which is dependent at least on the length of the items of laundry 10. It is also preferably the case, however, that the amount of blowing time required is determined in accordance with the width and/or the material, in particular where terry cloth is concerned, of the items of laundry 10.

For the purpose of blowing-time regulation, monitoring is carried out as to whether there is still part of the item of laundry 10 located in the upper region 31 of the blowing space 32. For this purpose, the lower, preferably horizontal, plane of the upper region 31, said plane being located at a parallel distance above the folding templates 23 and blowing tubes 25, 26 and having the sensor line 30 running through it, is monitored by the at least one transversely directed light barrier 27. If the sensor line 30 between the light source 28 and the reflector 29 of the light barrier 27, said sensor line being located in the lower plane of the upper region 31, is interrupted (FIG. 5), there is still part of the item of laundry 10 which is currently to be folded longitudinally located in the upper region 31 of the blowing space 32. This signals that the folding operation, which also requires a compressed-air jet exiting from the nozzles of the blowing tube 25 or 26, is still underway. As soon as a first (right-hand) peripheral region of the item of laundry 10, said first peripheral region having been folded over around the right-hand folding template 23 by the compressed-air jets from the right-hand blowing tube 25 in FIG. 6, has left the upper region 31 and the sensor line 30 is thus freed, the action of air exiting from the right-hand blowing tube 25 is interrupted and the operation of folding over the second peripheral region of the item of laundry 10 (the left-hand peripheral region in FIG. 6) around the left-hand folding template 23 can begin, by the compressed-air supply of the left-hand blowing tube 26 then being released. The compressed-air jet exiting from the left-hand blowing tube 26 then folds over the left-hand peripheral region of the item of laundry 10 around the left-hand folding template 23 onto the previously folded right-hand peripheral region of the item of laundry 10. The light barrier 27 detects, in turn, the completion of the folding operation of the left-hand peripheral region of the item of laundry 10 when the latter has left the upper region 31 of the blowing space 32 and is located beneath the sensor line 30 of the light barrier 27, in the lower region 33 of the blowing space 32. The longitudinal-folding operation of the item of laundry 10 in the longitudinal-folding station 13 has then been completed, and the compressed-air supply of the left-hand blowing tube 26 is also interrupted.

Following the longitudinal-folding operation of one item of laundry 10, the longitudinal-folding operation of the following item of laundry 10 can begin with the opening of the compressed-air supply of the right-hand blowing tube 25, which first of all folds over the right-hand peripheral region of the item of laundry 10 around the right-hand folding template 23. Thereafter, the folding operation of the left-hand peripheral region of the item of laundry 10 takes place in the previously described manner by virtue of the compressed-air supply of the blowing tubes 25 and 26 being changed over correspondingly and the compressed-air supply of the two blowing tubes 25, 26 being terminated following the second longitudinal-folding operation of the left-hand peripheral region of the item of laundry 10 on the previously folded right-hand peripheral region of the same.

Monitoring the upper region 31 of the blowing space 32 for the presence or absence of part of the item of laundry 10 makes it possible for the duration over which air exits from each of the blowing tubes 25, 26 to be controlled individually. Therefore, the one blowing tube 25 is still supplied with compressed air for as much time as is required by said blowing tube 25 in order to carry out the first longitudinal-folding operation of the relevant part of the item of laundry 10. The termination of the supply of compressed air to the blowing tube 25 for the first longitudinal-folding operation is accompanied at the same time, or slightly later, by the supply of compressed air to the other blowing tube 26 for the second longitudinal-folding operation of the other part of the item of laundry 10 being released, that is to say the compressed-air supply of the one blowing tube 25 or the other 26 is changed over automatically. In other words, the method according to the invention supplies each blowing tube 25, 26 with compressed air only for such a period of time as corresponds to the amount of time required for the respective longitudinal-folding operation. Moreover, the method according to the invention controls the beginning of the second transverse-folding operation, which takes place following the first transverse-folding operation.

According to the exemplary embodiment of FIG. 7, the longitudinal-folding operation of items of laundry 10 takes place basically by the same method described above in conjunction with the first exemplary embodiment (FIGS. 4 to 6). The only difference is that here the lower horizontal plane of the upper region 31 of the blowing space 32 is monitored by two light barriers 37, 38 which run longitudinally directed in the transporting direction 12.

The invention has been described above in conjunction with an apparatus for the combined folding of items of laundry 10 and stacking of folded items of laundry 10. The invention is also suitable for apparatuses which serve only for folding items of laundry 10, in particular for folding them at least longitudinally, or apparatuses by which folded items of laundry 10 are deposited merely on different lifting trucks 18 to 21.

It is also the case that the invention is not restricted to apparatuses for combined longitudinal-folding and transverse-folding operations. The invention is also suitable for apparatuses which serve only for folding items of laundry 10 longitudinally at least once. It is also the case that the invention is not restricted to apparatuses which have four lifting trucks 18 to 21, according to the exemplary embodiment shown in the figures. The invention is also suitable for apparatuses having more or fewer than four lifting trucks 18 to 21.

LIST OF DESIGNATIONS

10 Item of laundry
11 Infeed table
12 Transporting direction
13 Longitudinal-folding station
14 Cross-folding station
15 Delivery conveyor
16 Stacking device
17 Conveyor
18 Lifting truck
19 Lifting truck
20 Lifting truck
21 Lifting truck
22 Longitudinal conveyor
23 Folding template
24 Longitudinal periphery
25 Blowing tube
26 Blowing tube
27 Light barrier
28 Light source
29 Reflector
30 Sensor line
31 Upper region
32 Blowing space
33 Lower region
34 Outlet end
35 Length-measuring device
36 Front transverse edge
37 Light barrier
38 Light barrier

What is claimed is:

1. A method of mechanically folding items of laundry (10) and/or stacking items of laundry (10), wherein the items of laundry (10) are transported through at least one longitudinal-folding station (13), the items of laundry (10) are folded longitudinally at least once in the longitudinal-folding station (13) and the folded items of laundry (10) are stacked at a plurality of stacking locations, wherein the items of laundry (10) are transported through the longitudinal-folding station (13) at a transporting speed adapted to their size, wherein the transporting speed is adjusted such that relatively small items of laundry (10) are transported through the longitudinal-folding station (13) more quickly than larger items of laundry (10), and wherein the relatively small items of laundry (10) are accelerated in the longitudinal-folding station (13) and the larger items of laundry (10) are slowed down in the longitudinal-folding station (13), such that the at least one longitudinal-folding operation has been completed when a leading front transverse edge (36) of the items of laundry (10), said front transverse edge running transversely to the direction (12) in which the items of laundry (10) are transported through the longitudinal-folding station (13), is located in the region of an outlet end (34) of the longitudinal-folding station (13).

2. The method according to claim 1, wherein items of laundry (10) of which a length of the items of laundry corresponds more or less to a maximum longitudinal-folding length in the longitudinal-folding station (13) are transported through the longitudinal-folding station (13) until the at least one longitudinal-folding operation is stopped.

3. The method according to claim 1, wherein the speed at which the items of laundry (10) are transported through the longitudinal-folding station (13) is adapted individually to at least one of (a) the size of the respective item of laundry (10) and adjusted accordingly, in dependence on the size of the respective item of laundry (10) in relation to the length of the longitudinal-folding station (13) and (b) the amount of time required for the at least one longitudinal-folding operation of the respective item of laundry (10) in the longitudinal-folding station (13).

4. The method according to claim 1, wherein the speed at which items of laundry (10) are supplied to the longitudinal-folding station (13) is adapted to the speed at which the respective item of laundry (10) is transported through the longitudinal-folding station (13).

5. A method of mechanically folding items of laundry (10) and/or stacking items of laundry (10), wherein the items of laundry (10) are transported through at least one longitudinal-folding station (13), the items of laundry (10) are folded longitudinally at least once in the longitudinal-folding station (13) and the folded items of laundry (10) are stacked at a plurality of stacking locations, wherein the items of laundry (10) are transported through the longitudinal-folding station (13) at a transporting speed adapted to their size, wherein the transporting speed is adjusted such that relatively small items of laundry (10) are transported through the longitudinal-folding station (13) more quickly than larger items of laundry (10), and wherein the speed at which the items of laundry (10) are supplied to the longitudinal-folding station (13) is adjusted such that at least one of (a) the items of laundry (10) run into the longitudinal-folding station (13) directly one after the other and (b) the next item of laundry (10) runs into the longitudinal-folding station (13) as soon as all the longitudinal-folding operations of the preceding item of laundry (10) have been completed.

6. The method according to claim 1, further comprising determining dimensions of the items of laundry (10) in the transporting direction (12) through the longitudinal-folding station (13), at least one of (a) upstream of the longitudinal-folding station (13) and (b) during transportation to the longitudinal-folding station (13).

7. A method of mechanically folding items of laundry (10) and/or stacking items of laundry (10), wherein the items of laundry (10) are transported through at least one longitudinal-folding station (13), the items of laundry (10) are folded longitudinally at least once in the longitudinal-folding station (13) and the folded items of laundry (10) are stacked at a plurality of stacking locations, wherein the items of laundry (10) are transported through the longitudinal-folding station (13) at a transporting speed adapted to their size, wherein the transporting speed is adjusted such that relatively small items of laundry (10) are transported through the longitudinal-folding station (13) more quickly than larger items of laundry (10), and wherein the folded items of laundry (10) are transported from the final folding station to the individual stacking locations at different supply speeds.

8. The method according to claim 7, wherein the items of laundry (10) are transported at a greater supply speed to the stacking locations which are further remote from the final folding station than to the stacking locations which are closer to the final folding station.

9. The method according to claim 7, wherein at least one of (a) relatively short items of laundry (10), which are transported at a relatively great transporting speed through the longitudinal-folding station (13) and (b) items of laundry (10) requiring relatively short amounts of folding time, are stacked on at least one stacking location which is relatively remote from the final folding station.

10. A method of folding items of laundry (10), wherein the items of laundry (10) are transported through a longitudinal-folding station (13) having at least one folding template (23) and, in the longitudinal-folding station (13), the items of laundry (10) are folded over on the at least one folding template (23) by way of blowing air, wherein, during the longitudinal-folding operation, an upper region (31) of a folding region or blowing space (32) above the at least one folding template (23) is monitored as to whether there is still at least part of the respectively folded item of laundry (10) located in the upper region (31) of the folding region or blowing space (32), and the at least one folding operation and/or the supply of blowing air are/is controlled correspondingly, wherein only the upper region (31) of the folding region or blowing space (32) as is located at a distance above the at least one folding template (23) is monitored, and wherein the monitored upper region (31) is located above a main-extent surface area of the item of laundry (10) which is to be folded in each case.

11. The method according to claim 10, wherein the respective folding operation is terminated when the item of laundry (10) has left the upper region of the folding region or blowing space (32), and the supply of blowing air for the respective folding operation is interrupted when the termination of the respective folding operation has been established.

12. The method according to claim 10, wherein, in the case of a plurality of longitudinal-folding operations taking place one after the other, at least one of (a) the supply of blowing air is interrupted as soon as that region of the item of laundry (10) which is affected by the respective longitudinal-folding operation has left the monitored upper region (31) and (b) the supply of blowing air for the next longitudinal-folding operation of another part of the same item of laundry (10) is released.

* * * * *